US011818537B2

(12) United States Patent
Suzuki

(10) Patent No.: US 11,818,537 B2
(45) Date of Patent: Nov. 14, 2023

(54) ACOUSTIC REPRODUCTION DEVICE

(71) Applicant: SONY GROUP CORPORATION, Tokyo (JP)

(72) Inventor: Nobukazu Suzuki, Tokyo (JP)

(73) Assignee: SONY GROUP CORPORATION, Tokyo (JP)

( * ) Notice: Subject to any disclaimer, the term of this patent is extended or adjusted under 35 U.S.C. 154(b) by 207 days.

(21) Appl. No.: 17/309,665

(22) PCT Filed: Nov. 6, 2019

(86) PCT No.: PCT/JP2019/043492
§ 371 (c)(1),
(2) Date: Jun. 14, 2021

(87) PCT Pub. No.: WO2020/129443
PCT Pub. Date: Jun. 25, 2020

(65) Prior Publication Data

US 2022/0014844 A1 Jan. 13, 2022

(30) Foreign Application Priority Data

Dec. 21, 2018 (JP) ..... 2018-239108

(51) Int. Cl.
*H04R 1/34* (2006.01)
*H04R 1/02* (2006.01)
(Continued)

(52) U.S. Cl.
CPC ..... *H04R 1/345* (2013.01); *H04R 1/025* (2013.01); *H04R 1/24* (2013.01); *H04R 1/2834* (2013.01);
(Continued)

(58) Field of Classification Search
CPC ..... H04R 1/345; H04R 1/025; H04R 1/24; H04R 1/2834; H04R 3/00; H04R 7/12; H04R 9/025; H04R 9/04; H04R 9/06
(Continued)

(56) References Cited

U.S. PATENT DOCUMENTS 10,200,781 B2 * 2/2019 Yoo ..... H04R 1/025
2008/0013750 A1 * 1/2008 Suzuki ..... H04R 3/04 381/97
(Continued)

FOREIGN PATENT DOCUMENTS

BR PI1102744 A2 12/2012
CN 102316398 A 1/2012
(Continued)

OTHER PUBLICATIONS

Extended European Search Report of EP Application No. 19900307.0, dated Jan. 20, 2022, 10 pages.
(Continued)

*Primary Examiner* — Sean H Nguyen
(74) *Attorney, Agent, or Firm* — CHIP LAW GROUP

(57) ABSTRACT

Provided is an acoustic reproduction device that includes a first acoustic reproduction unit, and a second acoustic reproduction unit, in which the first acoustic reproduction unit includes a housing having a cylindrical shape and a vibration exciter that vibrates an end surface of one end of the housing. The second acoustic reproduction unit includes a speaker unit and a diffuser that changes a radiation direction of sound reproduced by the speaker unit. The housing, the speaker unit, and the diffuser are arranged so as to be substantially coaxial with a predetermined axis, and the diffuser causes a radiation direction of sound reproduced by the speaker unit and a radiation direction of sound from the first acoustic reproduction unit to be substantially a same.

11 Claims, 11 Drawing Sheets

(51) Int. Cl.

| | |
|---|---|
| ***H04R 1/24*** | (2006.01) |
| ***H04R 1/28*** | (2006.01) |
| ***H04R 3/00*** | (2006.01) |
| ***H04R 7/12*** | (2006.01) |
| ***H04R 9/02*** | (2006.01) |
| ***H04R 9/04*** | (2006.01) |
| ***H04R 9/06*** | (2006.01) |

(52) U.S. Cl.
CPC ..... *H04R 3/00* (2013.01); *H04R 7/12* (2013.01); *H04R 9/025* (2013.01); *H04R 9/04* (2013.01); *H04R 9/06* (2013.01)

(58) Field of Classification Search
USPC ..... 381/335
See application file for complete search history.

(56) References Cited

U.S. PATENT DOCUMENTS

| | | | | |
|---|---|---|---|---|
| 2012/0008818 | A1 | 1/2012 | Ohashi et al. | |
| 2017/0332166 | A1 | 11/2017 | Kikuchi et al. | |
| 2018/0249255 | A1 | 8/2018 | Ishii et al. | |
| 2019/0327554 | A1* | 10/2019 | Wang | G10K 11/26 |

FOREIGN PATENT DOCUMENTS

| | | | |
|---|---|---|---|
| CN | 108513240 | A | 9/2018 |
| EP | 2405672 | A1 | 1/2012 |
| JP | 52-96529 | A | 8/1977 |
| JP | 64-36294 | A | 2/1989 |
| JP | 01-36294 | B2 | 7/1989 |
| JP | 04-131094 | U | 12/1992 |
| JP | 5545083 | B2 | 7/2014 |
| JP | 2015-185869 | A | 10/2015 |
| JP | 6809228 | B2 | 1/2021 |
| KR | 10-2018-0099505 | A | 9/2018 |
| RU | 2011126877 | A | 1/2013 |
| WO | 2016/103931 | A1 | 6/2016 |

OTHER PUBLICATIONS

International Search Report and Written Opinion of PCT Application No. PCT/JP2019/043492, dated Jan. 28, 2020, 10 pages of ISRWO.

* cited by examiner

ACOUSTIC REPRODUCTION DEVICE

CROSS REFERENCE TO RELATED APPLICATIONS

This application is a U.S. National Phase of International Patent Application No. PCT/JP2019/043492 filed on Nov. 6, 2019, which claims priority benefit of Japanese Patent Application No. JP 2018-239108 filed in the Japan Patent Office on Dec. 21, 2018. Each of the above-referenced applications is hereby incorporated herein by reference in its entirety.

TECHNICAL FIELD

The present disclosure relates to an acoustic reproduction device.

BACKGROUND ART

Speaker devices of various shapes have been proposed. For example, Patent Document 1 below discloses a speaker device that extends in the vertical direction (up-and-down direction) with respect to a placement surface and has a substantially cylindrical shape as a whole.

CITATION LIST

Patent Document

Patent Document 1: WO 2016/103931

SUMMARY OF THE INVENTION

Problems to be Solved by the Invention

In such a field, improvement of quality of sound reproduced by a speaker device is desired.

Consequently, one of objects of the present disclosure is to provide an acoustic reproduction device with improved sound quality.

Solutions to Problems

For example, the present disclosure discloses an acoustic reproduction device including:

a first acoustic reproduction unit; and a second acoustic reproduction unit, in which the first acoustic reproduction unit includes:

a housing having a cylindrical shape; and a vibration exciter that vibrates an end surface of one end of the housing, the second acoustic reproduction unit includes:

a speaker unit; and a diffuser that changes a radiation direction of sound reproduced by the speaker unit, the housing, the speaker unit, and the diffuser are arranged so as to be substantially coaxial with a predetermined axis, and the diffuser causes a radiation direction of sound reproduced by the speaker unit and a radiation direction of sound from the first acoustic reproduction unit to be substantially a same.

MODE FOR CARRYING OUT THE INVENTION

Hereinafter, an embodiment and the like of the present disclosure will be described with reference to the drawings. Note that the description will be given in the following order.

Embodiment

Variations

The embodiment and the like described below are preferred specific examples of the present disclosure, and the contents of the present disclosure are not limited to the embodiment and the like.

Note that, in the following description, a stationary speaker device (acoustic reproduction device) will be described in an example. Note, however, that the speaker device according to the present disclosure is not limited to the stationary speaker device. For example, the speaker device according to the present disclosure can be achieved as, for example, a suspended speaker device suspended from a ceiling and the like and a speaker device integrally configured with a light.

Furthermore, although directions such as up, down, right, and left are described with reference to a direction facing the drawings for convenience of description, the description is merely an example, and the content of the present disclosure is not limited to the illustrated directions.

Embodiment

[Issues to Be Considered]

First, for ease of understanding of the present disclosure, issues to be considered will be described with reference to FIGS. 1A and 1B. Note that, in FIGS. 1A and 1B, the illustration of the configuration of a speaker device is simplified as appropriate.

Figure 1A:
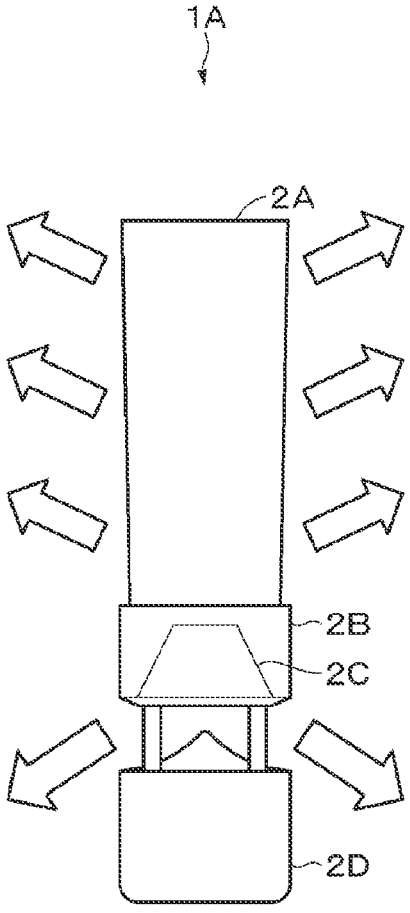
FIGS. 1A and 1B are referred to at the time when issues to be considered are described.
Figure 1B:
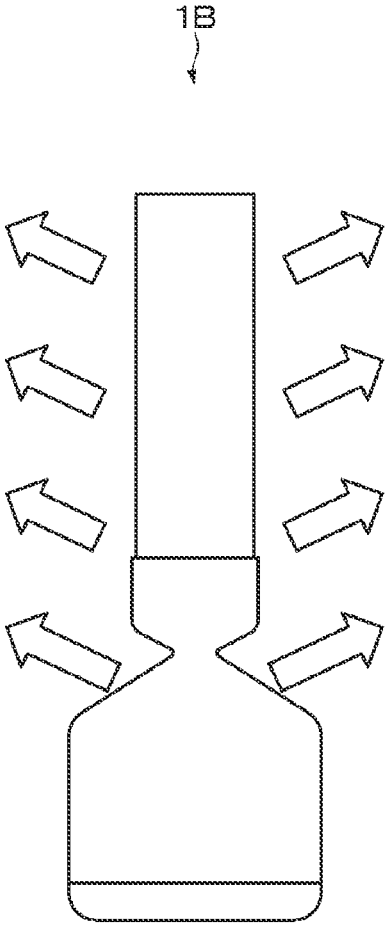

FIG. 1A illustrates the overall configuration of a common speaker device (speaker device 1A). The speaker device 1A includes, for example, a cylindrical diaphragm 2A, a support 2B, and a dynamic speaker unit 2C. The support 2B supports the diaphragm 2A. The speaker unit 2C is housed in the support 2B. Furthermore, the speaker device 1A includes a pedestal 2D that supports the diaphragm 2A and the support 2B. The bottom surface of the pedestal 2D is placed on an appropriate flat surface such as the upper surface of a floor, a desk, or a shelf. The speaker unit 2C is housed such that a sound radiation direction faces the lower side (placement surface side), for example.

Vibration given to a lower part of the diaphragm 2A of the speaker device 1A causes the diaphragm 2A to reproduce sound. For example, the vibration of the diaphragm 2A reproduces high-range (tweeter) sound. Furthermore, the speaker unit 2C reproduces downward sound. The speaker unit 2C reproduces midhigh-range (midrange) sound, for example. In FIG. 1A, arrows schematically indicate the radiation directions of reproduced sound. In the configuration of the speaker device 1A, the sound radiation directions differ for each band, as illustrated in FIG. 1A. This may cause a lack of sound connection and deterioration of sound quality. Consequently, as schematically illustrated in FIG. 1B, it is preferable that the radiation direction of sound reproduced by the diaphragm and the radiation direction of sound reproduced by the speaker unit is substantially the same. Details of the embodiment will be described on the basis of the above-described points.

Configuration Example of Speaker Device

Overall Configuration Example of Speaker Device

Figure 2:
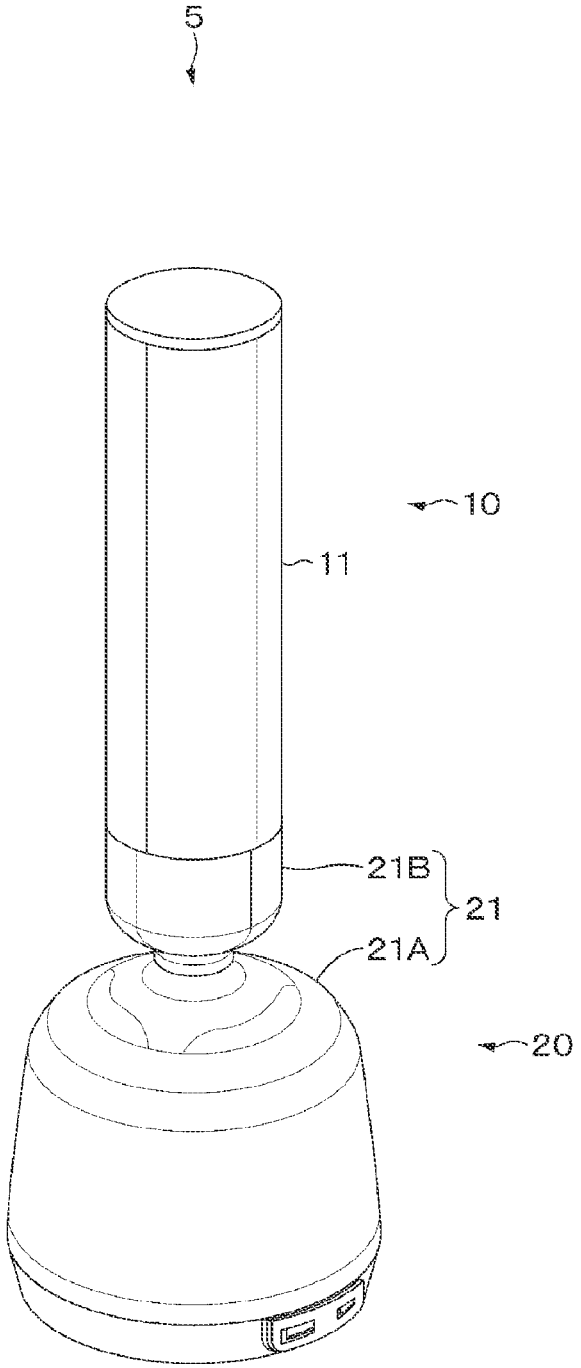
FIG. 2 illustrates an overall configuration example of a speaker device according to an embodiment.

FIG. 2 illustrates a configuration example of a speaker device (speaker device 5) according to the embodiment. The speaker device 5 schematically includes a first acoustic reproduction unit 10 and a second acoustic reproduction unit 20. The first acoustic reproduction unit 10 includes a cylindrical housing 11. The housing 11 according to the embodiment includes a light transmitting member. The light transmitting member includes glass, more specifically, an organic glass tube. The light transmitting member is not limited to a transparent member. The light transmitting member may be a member having a predetermined light transmittance such as translucent.

The second acoustic reproduction unit 20 includes a cabinet 21. The cabinet 21 includes a main cabinet 21A and a tip cabinet 21B. The main cabinet 21A has a truncated cone shape as a whole. The bottom surface of the main cabinet 21A corresponds to a placement surface that is placed on a flat surface of, for example, a floor and a desk. The tip cabinet 21B extends upward from the vicinity of the center of the upper surface of the main cabinet 21A, and has a hollow cylindrical shape as a whole. As illustrated in FIG. 2, one end of the housing 11 is inserted into the tip cabinet 21B, and then the cabinet 21 supports the housing 11.

In response to an audio signal input to the speaker device 5, vibration given to the housing 11 causes the housing 11 to vibrate, and the vibration reproduces sound corresponding to the audio signal. Any sound such as music, human voice, and natural sound may be reproduced. As described later, the main cabinet 21A houses a speaker unit. The speaker unit reproduces sound corresponding to an audio signal. For example, vibration of the housing 11 reproduces high-range sound. The speaker unit reproduces midhigh-range sound. Note that the band of sound reproduced in accordance with vibration of the housing 11 and the band of sound reproduced by the speaker unit may be the same or may be partially different.

Configuration Example of First Acoustic Reproduction Unit

Figure 3:
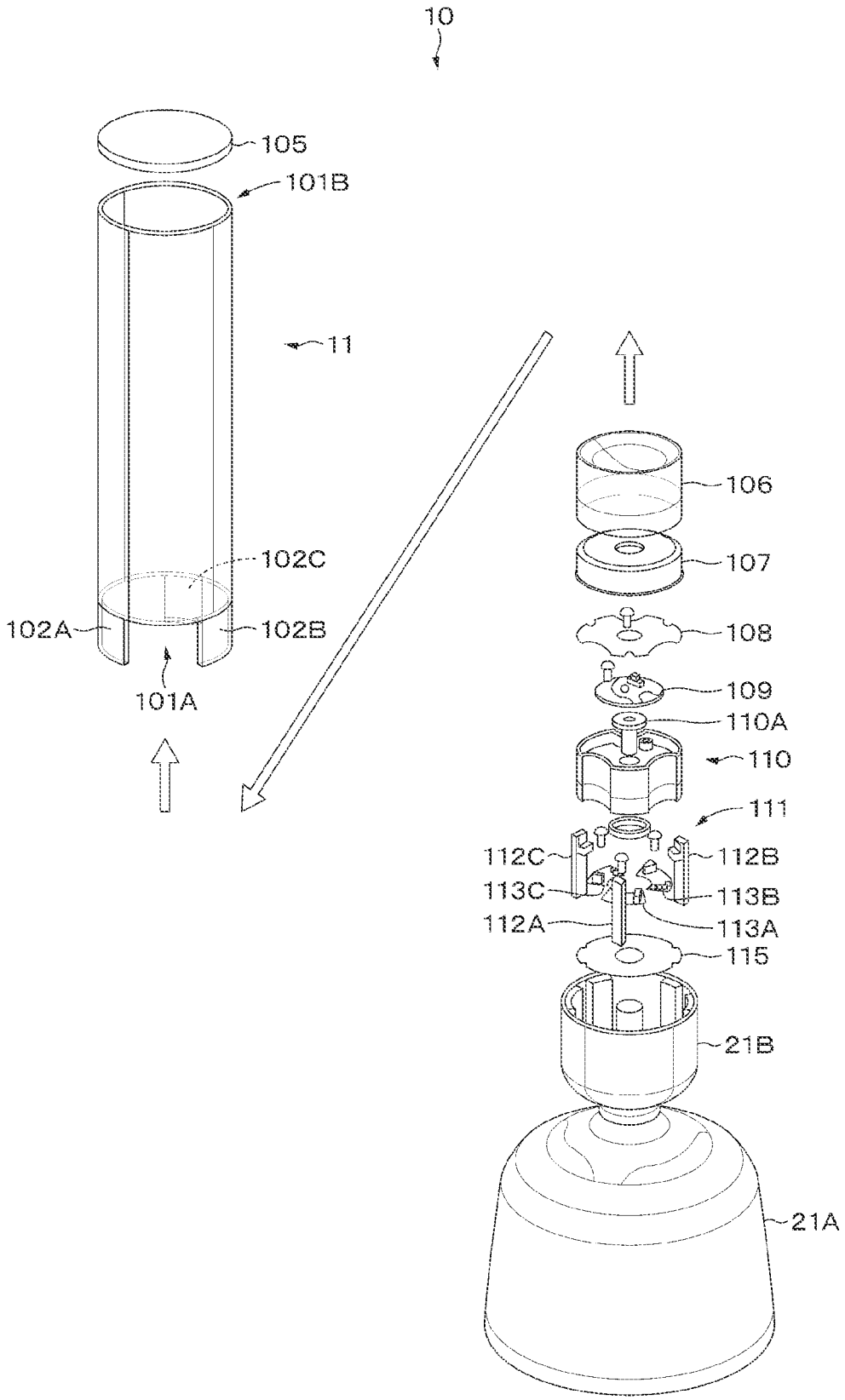
FIG. 3 is an exploded perspective view that is referred to at the time when a configuration example of a first acoustic reproduction unit according to the embodiment is described.
Figure 4:
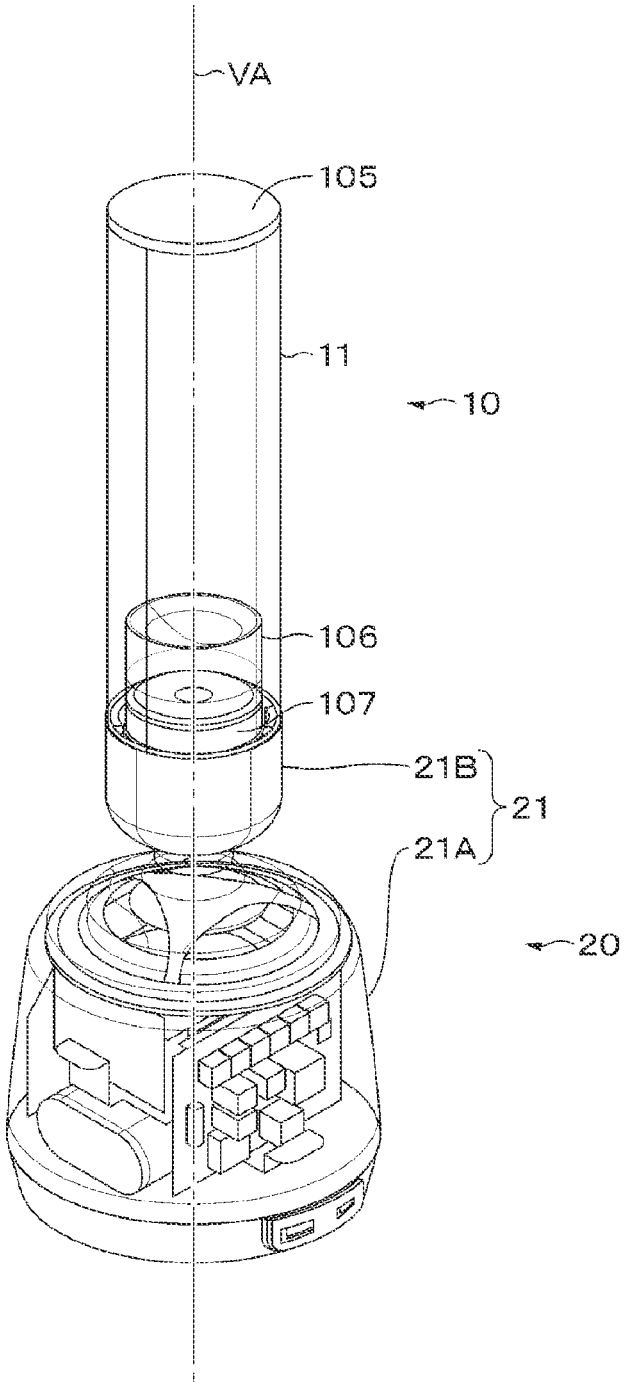
FIG. 4 is a perspective view of the speaker device according to the embodiment.

Next, a configuration example of the first acoustic reproduction unit 10 will be described with reference to FIGS. 3 and 4. FIG. 3 is an exploded perspective view of the first acoustic reproduction unit 10 and the like, the view being referred to at the time when a configuration example of the first acoustic reproduction unit 10 is described. Note that arrows in FIG. 3 indicate the order of arrangement of each configuration (similar thing applies to FIG. 5). FIG. 4 is a perspective view illustrating the speaker device 5 with which each configuration is integrated.

As described above, the first acoustic reproduction unit 10 includes a cylindrical housing 11. For example, glass and an acrylic plate can be used as the housing 11. In the present embodiment, an organic glass tube having a thickness of approximately 2 mm is used as the housing 11. A locking piece projecting downward is provided on one end surface 101A (end surface positioned on the lower side at the time when the speaker device 5 is placed) of the housing 11. In the present embodiment, three locking pieces (locking pieces 102A, 102B, and 102C) are provided at intervals of approximately 120 degrees in the circumferential direction of the circular end surface 101A. Note that, in a case where it is unnecessary to distinguish individual locking pieces, the locking pieces are abbreviated as locking pieces 102 as appropriate. Other configurations may be similarly abbreviated.

An open end on the side of the other end surface 101B of the housing 11 is closed by attaching a top cover 105. The top cover 105 is attached to the housing 11 by an appropriate attachment method such as a screw and a double-sided adhesive sheet.

The first acoustic reproduction unit 10 includes a transparent cylindrical clear case 106, a blister 107, a printed circuit board 108 for an antenna, a light emitter control board 109, the light emitter, and a light emitter holder 110. The light emitter control board 109 includes, for example, an integrated circuit (IC) that controls light emission of the light emitter. The light emitter holder 110 supports the light emitter. A light emitting diode (LED) and an organic electro luminescence (EL) element can be used as the light emitter. The light emitter is provided near the tip of a protrusion 110A protruding upward from the center of the light emitter holder 110, for example. In the state of the individual configurations are assembled, the protrusion 110A penetrates through a hole provided in the center of, for example, the blister 107, and is arranged in the clear case 106.

Furthermore, the first acoustic reproduction unit 10 includes a vibration exciter 111. The vibration exciter 111 according to the embodiment includes, for example, three vibrating elements (vibrating elements 112A, 112B, and 112C). For example, a laminated piezoelectric element can be used as the vibrating element 112. The vibrating element 112 has a prismatic shape extending in an up-and-down direction. The vibrating element 112 expands and contracts (displaces) in the up-and-down direction in response to an audio signal input to the speaker device 5 at the time when an appropriate drive voltage (drive signal) is applied. The vibrating element 112 is inserted into a vibrating element insertion hole formed on the inner peripheral surface of the tip cabinet 21B. The vibrating element 112 may be housed in an appropriate case.

The upper end surface of the vibrating element 112 abuts on the end surface 101A of the housing 11. For example, the upper end surface of the vibrating element 112A abuts on the end surface 101A between the locking piece 102A and the locking piece 102B. The upper end surface of the vibrating element 112B abuts on the end surface 101A between the locking piece 102B and the locking piece 102C. The end surface of the vibrating element 112C abuts on the end surface 101A between the locking piece 102C and the locking piece 102A. The housing 11 vibrates in response to the expansion and contraction of the vibrating element 112, and the vibration reproduces sound. Note that the vibrating element 112 may be an element other than a piezoelectric element (e.g., a magnetostrictive element) as long as the vibrating element 112 vibrates the housing 11.

Furthermore, the vibration exciter 111 includes a circuit unit that applies a voltage to the vibrating element 112. The vibration exciter 111 according to the embodiment includes, for example, three drive circuit units (drive circuit units 113A, 113B, and 113C) corresponding to three vibrating elements 112. For example, the drive circuit unit 113A supplies a drive voltage to the vibrating element 112A. The drive circuit unit 113B supplies a drive voltage to the vibrating element 112B. The drive circuit unit 113C supplies a drive voltage to the vibrating element 112C.

Furthermore, the first acoustic reproduction unit 10 includes an elastic deformation portion 115. The elastic deformation portion 115 is, for example, a spiral biasing spring. The elastic deformation portion 115 is attached to the locking pieces 102A to 102C of the housing 11 by, for example, screwing. The housing 11 is attached to the elastic deformation portion 115, and thereby biased downward by biasing force of the elastic deformation portion 115. That is, the housing 11 is biased in a direction of being pushed against the vibrating element 112 by the biasing force of the elastic deformation portion 115. Such configuration causes the elastic deformation portion 115 to give equal biasing forces to the lower side of the housing 11, and causes the housing 11 to be pushed against the vibrating element 112 in a stable state. Thus, a stable vibration state of the housing 11 can be secured.

As illustrated in FIG. 4, in the state in which each configuration is assembled, the clear case 106 and the blister 107 can be visually recognized in the housing 11. Other configurations such as the vibrating element 112 are housed in the tip cabinet 21B. Note that, although not illustrated in FIG. 4, a light emitter arranged in the clear case 106 (near one end of the housing 11) emits light. It is also possible to prevent the light emitter from emitting light. The presence or absence of light emission of the light emitter may be set as a mode. Light emission of the light emitter allows reproduction of an audio signal in the manner in which a candle is lit. Displacing the protrusion 110A provided with the light emitter to sway the protrusion 110A allows the manner in which a candlelight is swayed.

Configuration Example of Second Acoustic Reproduction Unit

Figure 5:
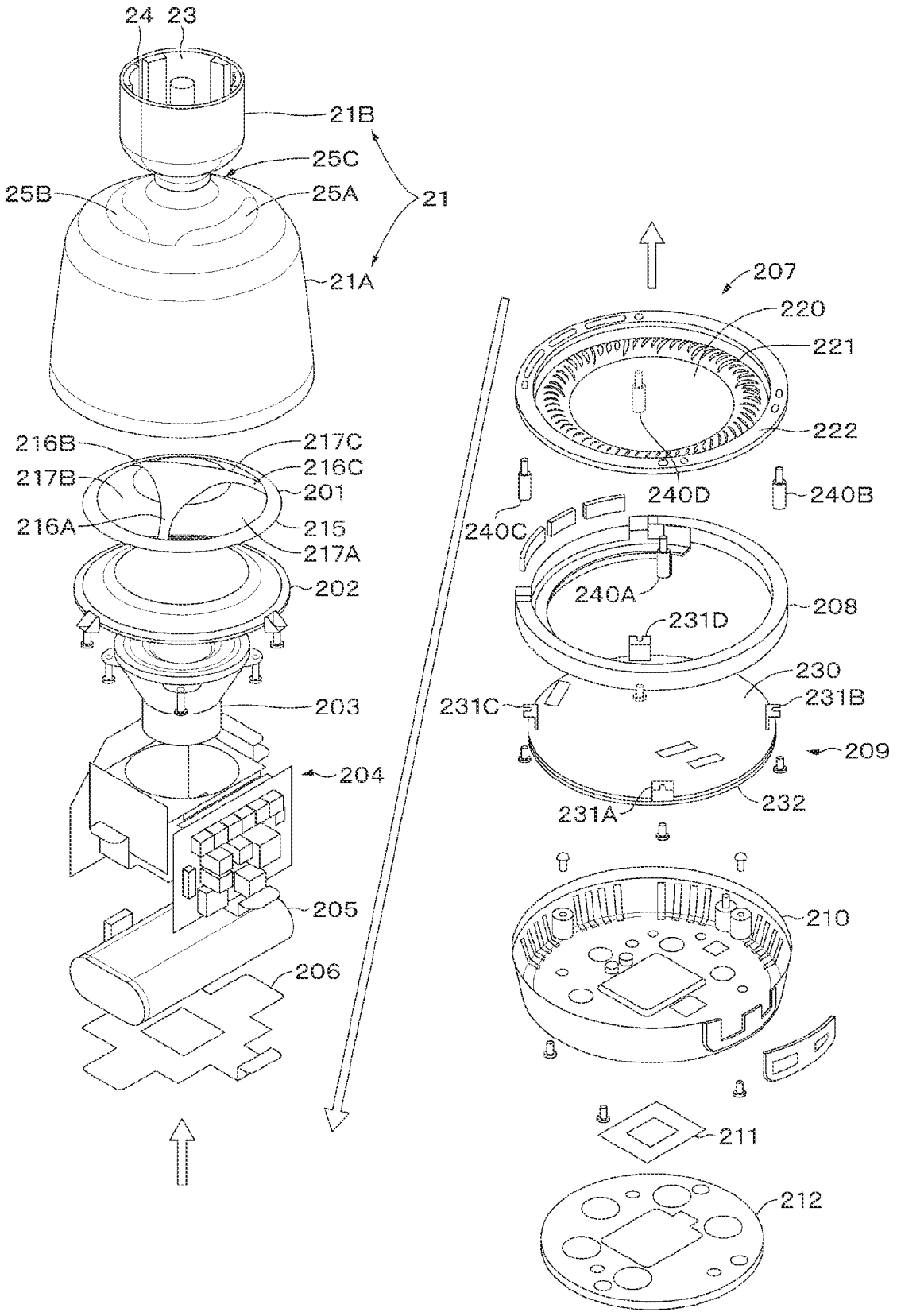
FIG. 5 is an exploded perspective view that is referred to at the time when a configuration example of a second acoustic reproduction unit according to the embodiment is described.

Next, a configuration example of the second acoustic reproduction unit 20 will be described with reference to FIGS. 4 and 5. FIG. 5 is an exploded perspective view of the second acoustic reproduction unit 20, the view being referred to at the time when a configuration example of the second acoustic reproduction unit 20 is described.

As described above, the second acoustic reproduction unit 20 according to the embodiment includes the cabinet 21 in which the main cabinet 21A and the tip cabinet 21B are continuously formed. The cabinet 21 includes a metal material such as zinc and aluminum. The cabinet 21 according to the present embodiment includes zinc. In one example, the cabinet 21 is made by a manufacturing method called die-casting in which molten metal is pressed into a mold.

A locking piece insertion hole 23 and a vibrating element insertion hole 24 are formed on the inner peripheral surface of the tip cabinet 21B. The number of formed locking piece insertion holes 23 corresponds to the number (three in the present embodiment) of locking pieces of the housing 11. The number of formed vibrating element insertion holes 24 corresponds to the number (three in the present embodiment) of the vibrating elements 112 of the housing 11. One end of the housing 11 is supported by the tip cabinet 21B by inserting the locking piece 102 into the locking piece insertion hole 23 and inserting the vibrating element 112 into the vibrating element insertion hole 24.

A diffuser 201, a baffle plate 202, a speaker unit 203, a control board block 204, a battery 205, a battery holder 206, a passive radiator 207, a spacer 208, a control board 209, a cover member 210, a near field communication (NFC) board 211, and a bottom surface cover 212 are housed in the internal space of the main cabinet 21A sequentially from the side of the tip cabinet 21B.

The diffuser 201 includes a base 215 having a ring shape. The top of the diffuser 201 is positioned near the center of the base 215. The diffuser 201 has a shape of being displaced downward from the top to the outside. Furthermore, the diffuser 201 includes a coupling arm that couples the top and the base 215. The diffuser 201 according to the present embodiment includes three coupling arms (coupling arms 216A, 216B, and 216C). Then, the diffuser 201 has three openings (openings 217A, 217B, and 217C) partitioned by the coupling arms.

Holes that at least partially communicate with these openings 217 are formed on the upper surface of the main cabinet 21A. Specifically, a hole 25A, a hole 25B, and a hole 25C are provided in the main cabinet 21A. The hole 25A communicates with the opening 217A. The hole 25B communicates with the opening 217B. The hole 25C communicates with the opening 217C. Sound reproduced by the speaker unit 203 is transmitted toward the outside of the speaker device 5 through the opening 217 and the hole 25. At this time, the diffuser 201 changes the radiation direction of sound reproduced by the speaker unit 203 such that the sound diffuses upward toward the surroundings.

The baffle plate 202 has a ring shape as a whole. The baffle plate 202 is attached around the sound radiation surface of the speaker unit 203 by an appropriate method such as screwing.

The speaker unit 203 is, for example, a dynamic speaker unit. The speaker unit 203 includes a diaphragm, a magnetic circuit, a bobbin, and a coil (some of these configurations are not illustrated). The magnetic circuit includes a magnetic gap. The bobbin is attached to a voice coil attachment unit provided on the diaphragm. The coil is wound around the bobbin. The speaker unit 203 reproduces, for example, midhigh-range sound. The speaker unit 203 may reproduce sound including a low range. The speaker unit 203 is arranged such that sound from the speaker unit 203 according to the embodiment radiates upward (toward the side of the tip cabinet 21B).

The control board block 204 is obtained by integrating a box-shaped configuration and a control board. The box-shaped configuration houses the speaker unit 203. For example, an IC is implemented on the control board. The IC performs various pieces of acoustic signal processing on an audio signal supplied to the speaker unit 203. The speaker unit 203 is housed and held in the control board block 204.

The battery 205 is a power source that supplies electric power to each part of the speaker device 5. A chargeable/dischargeable secondary battery such as a lithium-ion battery can be used as the battery 205. As a result, the speaker device 5 can be used at any place. The battery 205 may be a primary battery. Furthermore, the speaker device 5 may be connected to a commercial power source by a cord, and may be driven by the commercial power source. The battery holder 206 holds the battery 205 at a predetermined position. The thin plate-shaped battery holder 206 divides the inside of the main cabinet 21A into upper and lower parts.

The passive radiator 207 vibrates along with the reproduction of an audio signal, and mainly outputs low-range sound. The passive radiator 207 includes a circular flat portion 220, an edge 221, and an outer peripheral edge (frame) 222. The edge 221 is positioned on the periphery of the flat portion 220, and projects upward. The outer peripheral edge 222 is positioned around the edge 221, and includes, for example, metal. The flat portion 220 and the edge 221 are integrally formed by using vulcanized rubber, such as isobutyene/isoprene rubber (IIR) and acrylonitrile/butadiene rubber (NBR), or non-vulcanized rubber. The integrated object is supported by the circular outer peripheral edge 222.

The spacer 208 secures a predetermined gap between the passive radiator 207 and the control board 209.

The control board 209 includes a printed circuit board 230 and a metal plate 232. For example, an IC for controlling the operation of the passive radiator 207 is mounted on the printed circuit board 230. The metal plate 232 is fixed to the back surface (lower surface) of the printed circuit board 230 by, for example, screwing. The metal plate 232 is a sheet metal having a thickness of, for example, approximately 1.5 mm (millimeters).

Four protrusions (protrusions 231A, 231B, 231C, and 231D) of the metal plate 232 protrude upward from predetermined positions on the periphery of the printed circuit board 230. The four protrusions 231 and predetermined positions of the outer peripheral edge 222 of the passive radiator 207 described above are attached via the spacer 208 by using four screwdrivers (screwdrivers 240A, 240B, 240C, and 240D). Such configuration allows vibration generated by the operation of the passive radiator 207 to propagate to the metal plate 232. The metal plate 232 serves as the acoustic ground of the passive radiator 207.

The cover member 210 has a dish shape with the periphery protruding upward. The control board 209 is housed and held in the cover member 210.

An IC for short-distance wireless communication in conformity with a standard of NFC is mounted on the NFC board 211. Note that, the standard of the short-distance wireless communication is not limited to NFC, and may be, for example, a local area network (LAN), Bluetooth (registered trademark), Wi-Fi (registered trademark), or a wireless USB (WUSB). Furthermore, wired communication may be performed between the speaker device 5 and another device.

The bottom surface cover 212 closes the bottom surface of the main cabinet 21A. The bottom surface cover 212 is attached by, for example, screwing or using a double-sided adhesive sheet. The back surface of the bottom surface cover 212 serves as a placement surface for the speaker device 5.

FIG. 4 illustrates the state in which each configuration is housed in the main cabinet 21A. In the speaker device 5 according to the present embodiment, as illustrated in FIG. 4, the housing 11, the diffuser 201, and the speaker unit 203 are arranged so as to be substantially coaxial with a virtual axis VA. Being substantially coaxial means that the deviation from the virtual axis VA has a value equal to or less than a predetermined value.

Furthermore, in the speaker device 5 according to the present embodiment, the deviation from the axis VA in relation to the gravity center of a configuration other than the housing 11, the diffuser 201, and the speaker unit 203 has a value equal to or less than a predetermined value. Each configuration is arranged near the center in the main cabinet 21A. Furthermore, a heavy configuration (e.g., battery 205) is arranged on the relatively lower side in the main cabinet 21A. Such configuration can lower the gravity center of the speaker device 5.

Operation Example of Speaker Device

Next, an operation example of the speaker device 5 according to the embodiment will be described. An audio signal is input to the speaker device 5. The audio signal is supplied by, for example, wireless communication. The audio signal may be supplied by wire.

The speaker unit 203 reproduces the input audio signal. The diffuser 201 positioned above the speaker unit 203 reproduces sound reproduced by the speaker unit 203 in a predetermined radiation direction. Specifically, the diffuser 201 radiates sound upward and in a direction toward the surroundings of the speaker device 5. The sound reproduced by the speaker unit 203 is emitted around the speaker device 5 through the opening 217 and the hole 25.

In contrast, in a case where a drive signal corresponding to an audio signal is input from the drive circuit unit 113 to the vibrating element 112, the vibrating element 112 expands and contracts in the up-and-down direction in response to the input drive signal. The housing 11 pushed against the vibrating element 112 vibrates in response to the expansion and contraction of the vibrating element 112. In a case where the housing 11 vibrates, for example, high-range sound is output. In this way, the audio signal is reproduced by the speaker unit 203, and reproduced by vibration of the housing 11. The lower side of the housing 11 is vibrated and the vibration propagates from the lower side to the upper side. Sound generated by the vibration of the housing 11 thus spreads upward. In this way, as schematically illustrated in FIG. 1B, the configuration in which the housing 11, the diffuser 201, and the speaker unit 203 are arranged substantially coaxially allows the radiation direction of sound from the speaker unit 203 and the radiation direction of sound reproduced by vibration of the housing 11 to be substantially the same. The audio signal is reproduced for the spread from the speaker device 5 in the 360° direction.

Moreover, the passive radiator 207 is driven in accordance with the audio signal, and the passive radiator 207 reproduces low pitch sound. The passive radiator 207 enhances the low pitch sound. The low pitch sound reproduced by the passive radiator 207 propagates to a surface in contact with the placement surface (bottom surface) of the speaker device 5, that is, a contact surface of, for example, a desk and a floor on which the speaker device 5 is placed, and then spreads. In the speaker device 5 according to the present embodiment, the vibration generated by the operation of the passive radiator 207 propagates to the metal plate 232, causing the metal plate 232 to vibrate. The vibration propagates to the contact surface via the placement surface of the speaker device 5. The passive radiator 207 and the metal plate 232 are directly attached, and the metal plate 232 is provided near the placement surface, that is, on the lower side in the main cabinet 21A. This configuration can efficiently propagate vibration to the contact surface.

Furthermore, the vibrating element 112 and the passive radiator 207 vibrate in the same direction (up-and-down direction). Consequently, force (tension) in a horizontal direction is hard to be applied. This prevents the speaker device 5 from horizontally moving on the contact surface in response to the vibration of the vibrating element 112 and the passive radiator 207.

Furthermore, as described above, in the speaker device 5 according to the present embodiment, a configuration is arranged near the center in the main cabinet 21A. This arrangement can prevent the speaker device 5 from horizontally moving on the contact surface as the passive radiator 207 displaces in the up-and-down direction with respect to the contact surface.

Furthermore, using zinc having a large specific gravity as a material of the cabinet 21 to lower the gravity center of the speaker device 5 can prevent the speaker device 5 from moving along with the operation of the passive radiator 207, and efficiently propagate vibration caused by the operation of the passive radiator 207 to the contact surface.

Configuration Example of Signal Processing Unit

Figure 6:
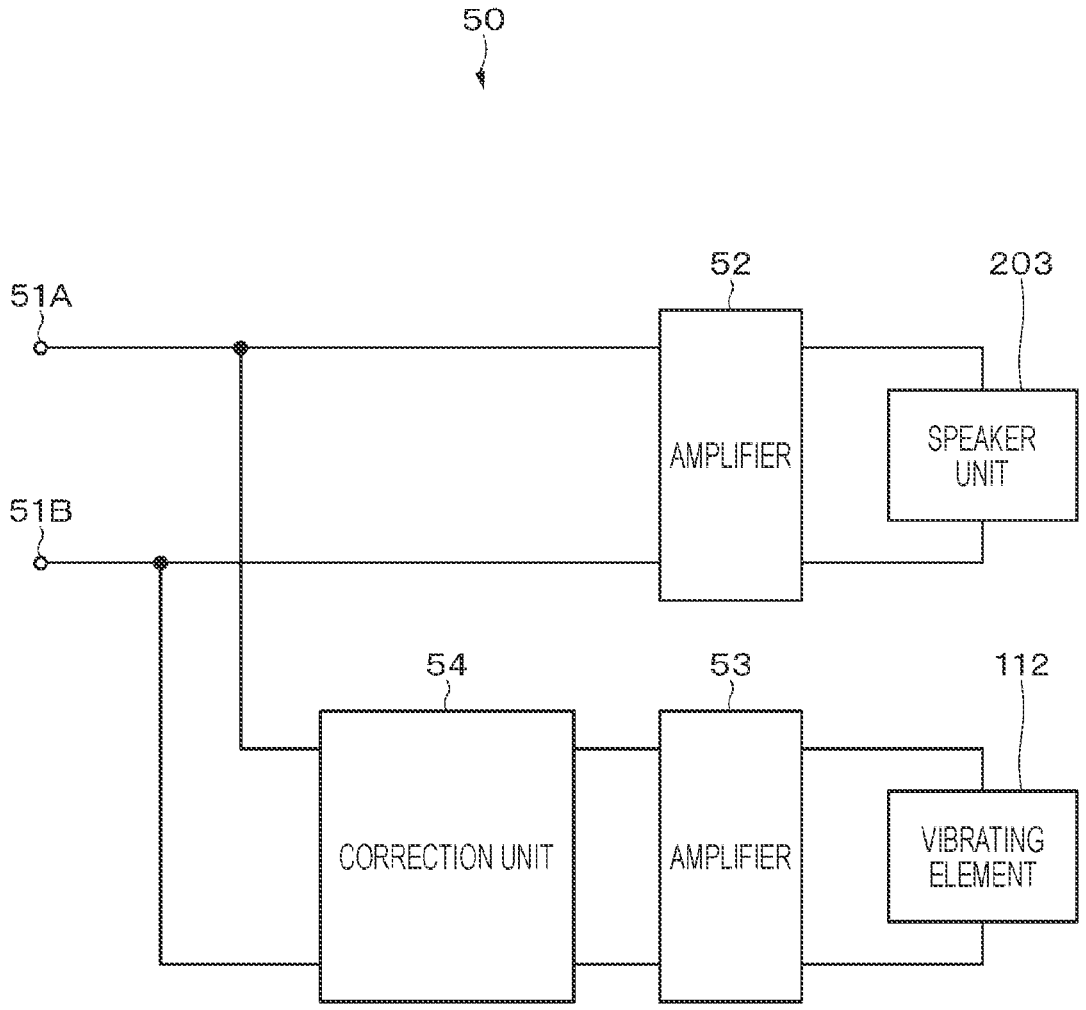
FIG. 6 is a block diagram illustrating a configuration example of a signal processing unit according to the embodiment.

Next, a configuration example of a signal processing unit (signal processing unit 50) of the speaker device 5 will be described. FIG. 6 is a block diagram illustrating a configuration example of the signal processing unit 50. The signal processing unit 50 includes input terminals 51A and 51B, amplifiers 52 and 53, and a correction unit 54. For example, two-channel audio signals are input to the input terminals 51A and 51B. The input audio signals are branched and supplied to each of the amplifier 52 and the correction unit 54. The amplifier 52 amplifies the audio signal, and supplies the amplified audio signal to the speaker unit 203. The speaker unit 203 reproduces the audio signal.

Here, in a case where a piezoelectric element is used as the vibrating element 112, the difference in responsiveness between the speaker unit 203 and the piezoelectric element may cause a deviation of timing of sound waves radiated by each of the speaker unit 203 and the piezoelectric element into the air. In general, since the piezoelectric element has a faster responsiveness than the speaker unit 203, sound caused by vibration of the housing 11 is generated faster. Thus, as illustrated in FIG. 6, the correction unit 54 may be provided in the signal processing unit 50. The correction unit 54 performs, for example, correction (time correction) for delaying an audio signal so that sound reproduction performed by the speaker unit 203 and sound reproduction caused by vibration of the vibrating element 112 are performed substantially at the same timing. The correction unit 54 may perform processing of correcting the phase of an audio signal together with the time correction.

The amplifier 53 amplifies the audio signal corrected by the correction unit 54. The amplified audio signal is supplied to the vibrating element 112, and the vibrating element 112 vibrates in response to the audio signal. Note that, although detailed illustration is omitted, the correction unit 54 has, for example, an analog to digital (A/D), D/A conversion function. The correction unit 54 performs the above-described correction processing by digital signal processing. Note that the signal processing unit 50 may perform another piece of known acoustic signal processing.

Figure 7:
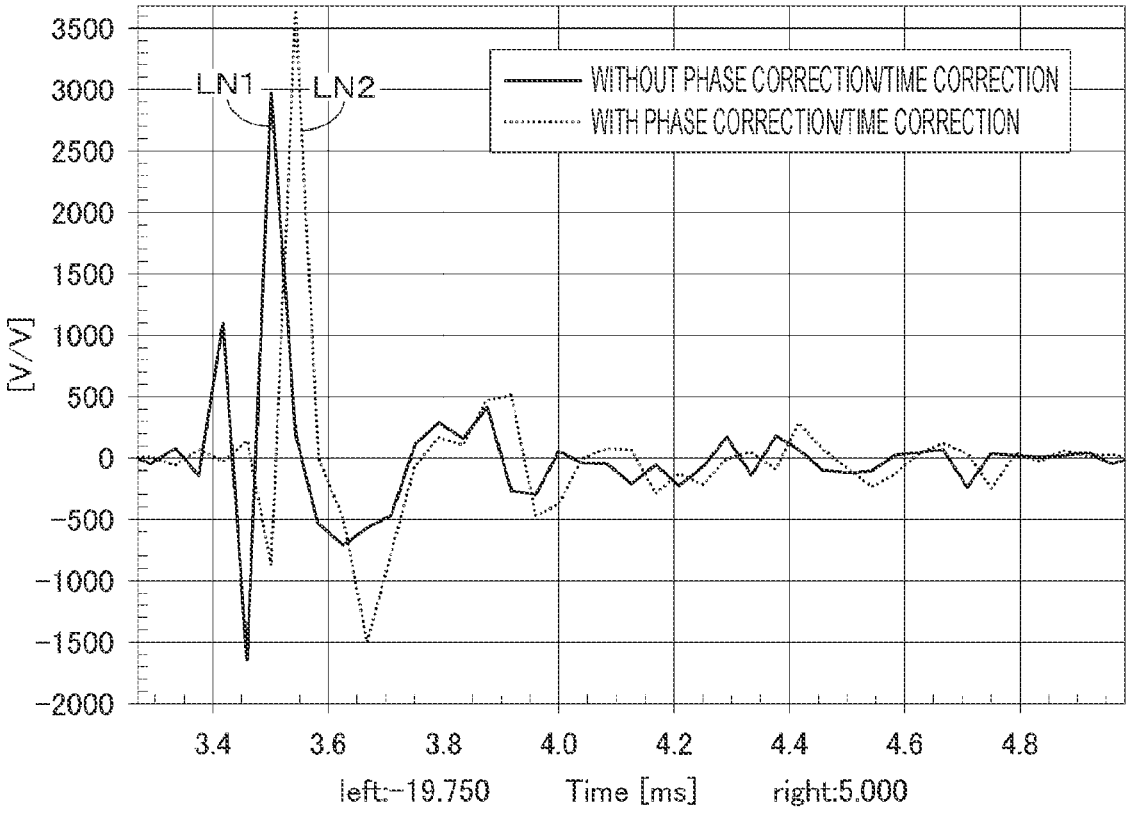
FIG. 7 is a graph illustrating a response (impulse response) in a case where a predetermined impulse signal is input.

One example of effects obtained by such configuration will be described with reference to FIG. 7. FIG. 7 is a graph illustrating a response (impulse response) in a case where a predetermined impulse signal is input. The horizontal axis of the graph in FIG. 7 indicates a time axis, and the vertical axis indicates the level (magnitude) of the impulse response. Furthermore, a solid line LN1 in FIG. 7 indicates an impulse response in a case where the correction unit 54 performs no correction processing. A dotted line LN2 indicates an impulse response in a case where the correction unit 54 performs the correction processing. As illustrated in FIG. 7, acoustic energy indicated by the line LN2 is larger than acoustic energy indicated by the line LN1. In this way, the acoustic energy can be maximized by correction processing performed by the correction unit 54, which improves sound quality.

Example

Next, an example of the embodiment will be described. Note that the content of the present disclosure is not limited to the following example.

Figure 8:
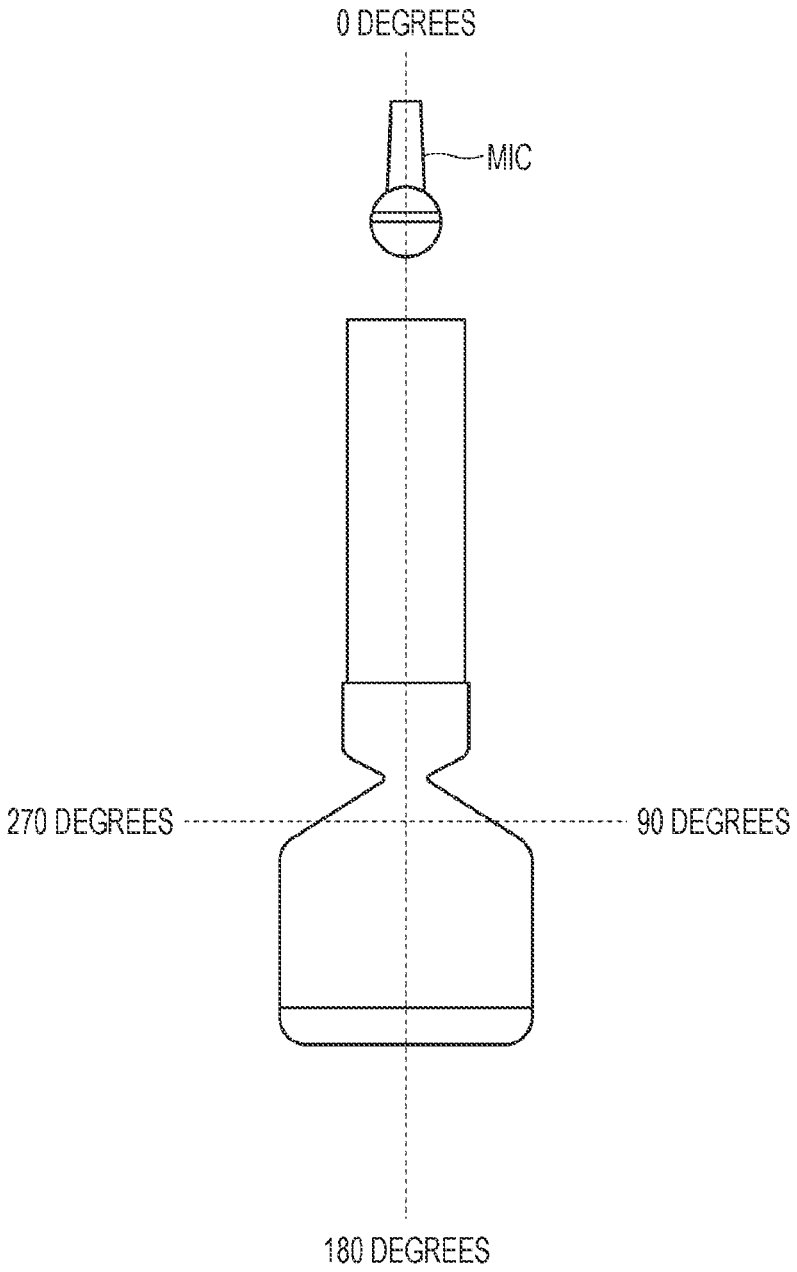
FIG. 8 illustrates a measurement method in an example of the embodiment.

As illustrated in FIG. 8, the speaker device 5 is placed on a turntable in a laid state. Axes are set in the vertical direction and the horizontal direction. A microphone MIC is arranged beyond the tip (other end) of the housing 11 of the speaker device 5. The microphone MIC collects sound reproduced by the speaker device 5. The speaker device 5 is rotated in the 360° direction by rotating the turntable. Sound collected by the microphone MIC as a result was evaluated. Note that the measurement was performed in an anechoic chamber.

Figure 9A:
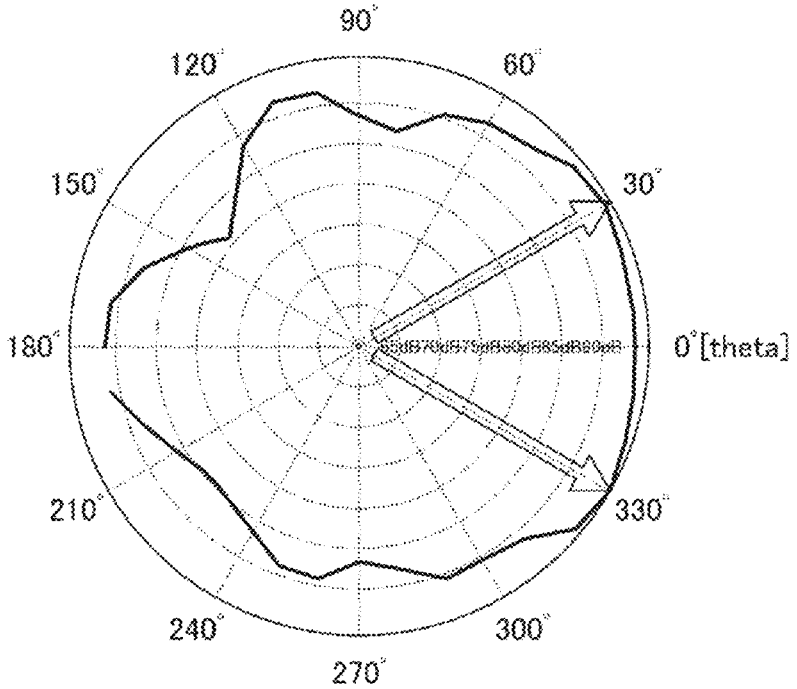
FIGS. 9A and 9B are graphs of the sound pressure level for each angle of reproduced sound with a constant frequency.
Figure 9B:
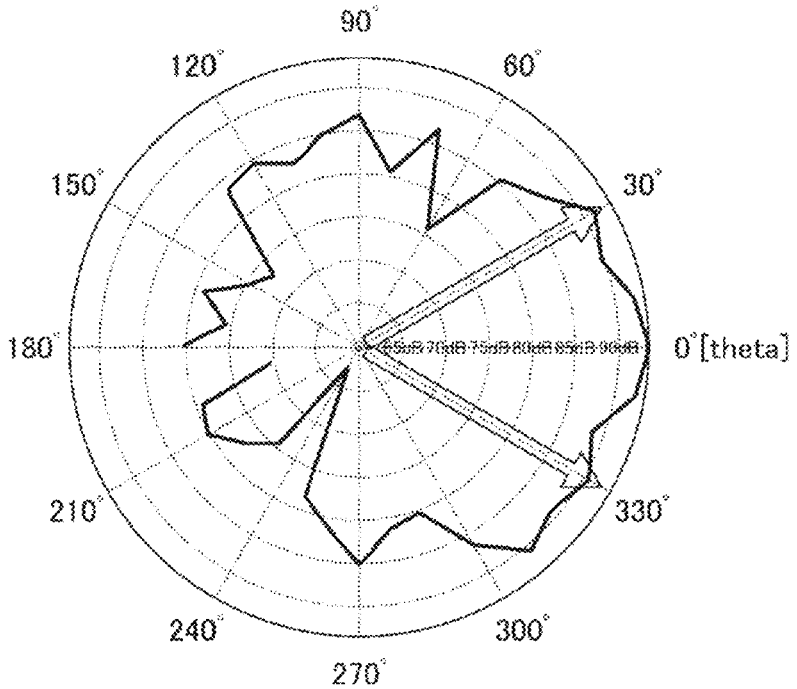

FIGS. 9A and 9B are graphs of the sound pressure level for each angle of reproduced sound with a constant frequency. FIG. 9A illustrates a result in a case where the frequency is set in a midhigh range (3 kHz in a specific example). FIG. 9B illustrates a result in a case where the frequency is set in a high range (6 kHz in a specific example). The speaker unit 203 reproduces midhigh-range sound. Vibration of the housing 11 reproduces high-range sound.

As illustrated in FIGS. 9A and 9B, the sound pressure level above the speaker device 5 (e.g., range of 0° to 30° and the range of 330° to 0°) is large in both the figures. Such a result indicates that the radiation direction of sound reproduced by the speaker unit 203 and the radiation direction of sound reproduced by vibrating the housing 11 are substantially the same.

Figure 10:
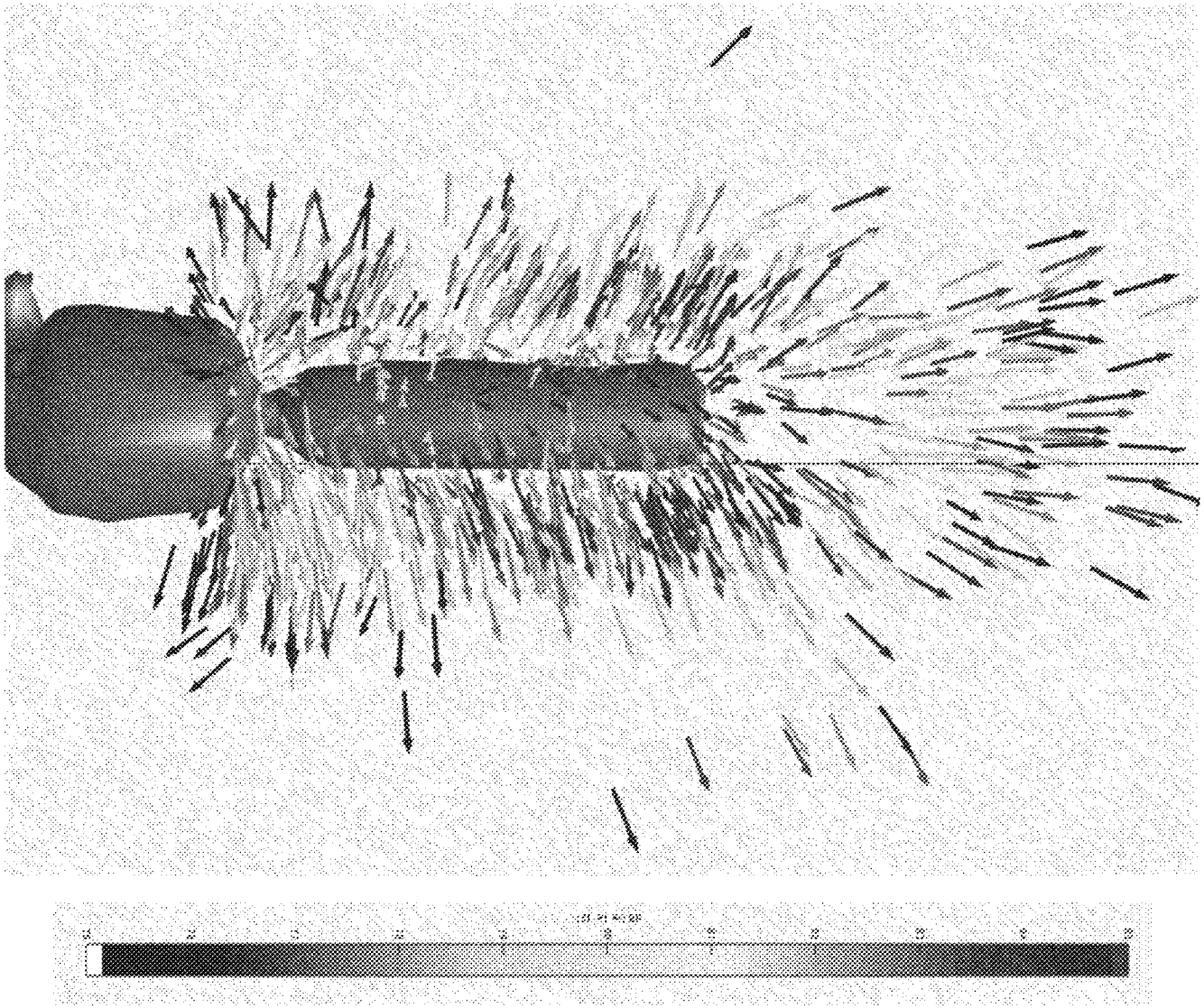
FIG. 10 illustrates one example of effects obtained by the embodiment.
Figure 11B:
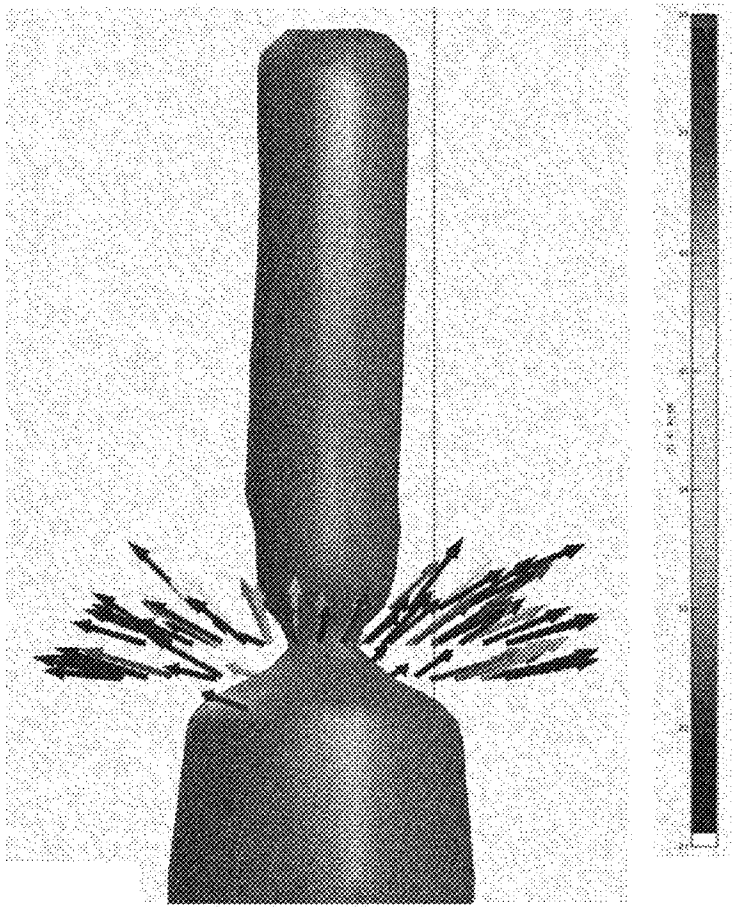
FIGS. 11A and 11B illustrate one example of effects obtained by the embodiment.
Figure 11A:
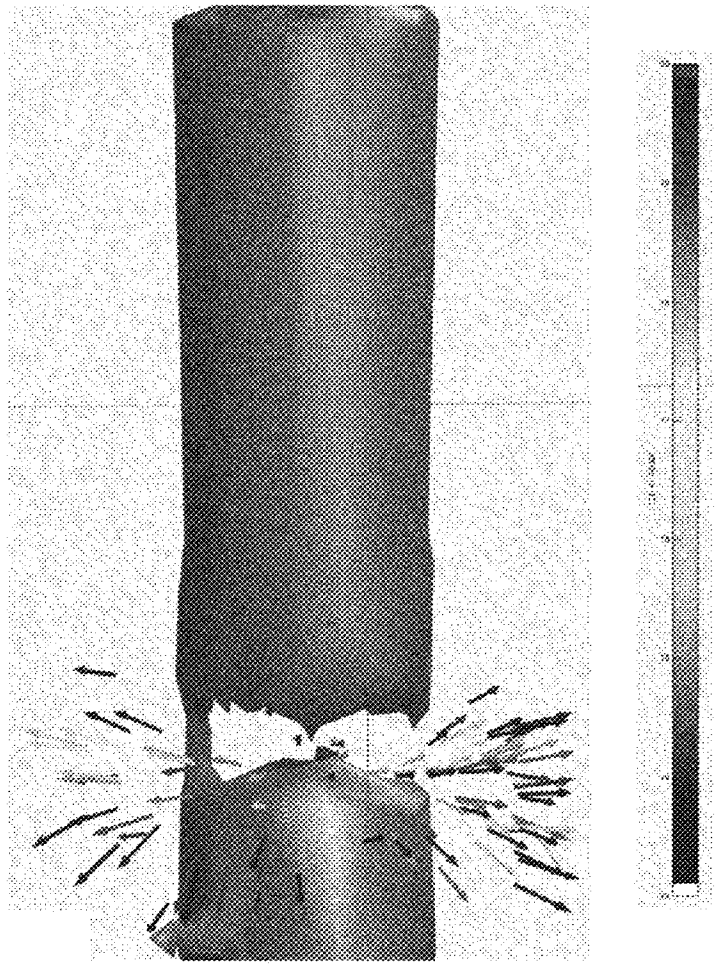

FIG. 10 illustrates one example of acoustic intensity measurement results from 4 to 10 kHz obtained by using the speaker device according to the embodiment, and it can be seen that the radiation direction of sound waves on the side of the tweeter (TW) W is directed diagonally upward. Furthermore, FIG. 11A illustrates an acoustic intensity measurement result of 1 kHz obtained by using a known speaker device. FIG. 11B illustrates an acoustic intensity measurement result of 1 kHz obtained by using the speaker device according to the embodiment. In FIG. 11A, sound waves are also radiated downward. According to the speaker device of the present embodiment, however, almost all sound waves are directed diagonally upward. As described above, according to the speaker device of the present embodiment, the configuration in which sound is emitted upward can reduce influences of a floor surface (contact surface) on reproduced sound. Specifically, it is possible to prevent reproduced sound from being mixed with reflected sound and becoming acoustically dull due to unnecessary reflected sound from the floor surface.

[Variations]

Although the embodiment of the present disclosure has been specifically described above, the present disclosure is not limited to the above-described embodiment, and various variations based on the technical idea of the present disclosure are possible.

Although, in the above-described embodiment, sound reproduced by the speaker unit 203 is radiated upward, the sound may be radiated downward (on the side opposite to the side where the tip cabinet 21B is arranged). Then, a diffuser may be arranged on the side of the sound radiation direction so that the diffuser causes sound reproduced by the speaker unit 203 to reflect upward.

Although, in the above-described embodiment, the housing 11 includes a light transmitting member in consideration of design, the housing 11 may include a light non-transmitting member. Examples of the light non-transmitting member include, for example, metal, leather, wood, fiber, and bamboo.

The number, position, and the like of the vibrating element, screwing, and the like described in the embodiment are merely examples. For example, less than three vibrating elements may be provided, or more than three vibrating elements may be provided. The number of vibrating elements may be increased, and a vibrating element to which a drive signal is supplied may be dynamically switched in accordance with the characteristics of an audio signal.

The configurations, methods, processes, shapes, materials, numerical values, and the like in the above-described embodiment are merely examples, and different configurations, methods, processes, shapes, materials, numerical values, and the like may be used as necessary. The above-described embodiment and variations can be combined as appropriate.

The present disclosure may also adopt the following configurations.

(1)

An acoustic reproduction device including:

a first acoustic reproduction unit; and a second acoustic reproduction unit, in which the first acoustic reproduction unit includes:

a housing having a cylindrical shape; and a vibration exciter that vibrates an end surface of one end of the housing, the second acoustic reproduction unit includes:

a speaker unit; and a diffuser that changes a radiation direction of sound reproduced by the speaker unit, the housing, the speaker unit, and the diffuser are arranged so as to be substantially coaxial with a predetermined axis, and the diffuser causes a radiation direction of sound reproduced by the speaker unit and a radiation direction of sound from the first acoustic reproduction unit to be substantially a same.

(2)

The acoustic reproduction device according to (1), in which the second acoustic reproduction unit includes a cabinet, the cabinet has a shape in which a tip cabinet and a main cabinet are continuously formed, the vibration exciter and one end of the housing are housed inside the tip cabinet, and the diffuser and the speaker unit are housed inside the main cabinet from a side of the tip cabinet.

(3)

The acoustic reproduction device according to (2), in which the diffuser has a plurality of openings, and the main cabinet has a plurality of openings communicating with the plurality of openings.

(4)

The acoustic reproduction device according to (2) or (3), in which a passive radiator arranged substantially coaxially with the predetermined axis is housed inside the main cabinet, and vibration generated by operation of the passive radiator propagates to a placement surface of the main cabinet.

(5)

The acoustic reproduction device according to (4), in which a metal plate is housed in a vicinity of the placement surface inside the main cabinet, and the passive radiator and the metal plate are connected.

(6)

The acoustic reproduction device according to any one of (1) to (5), in which the speaker unit is housed inside the main cabinet such that a radiation direction of sound reproduced by the speaker unit faces a side opposite to a side toward the tip cabinet or a side where the tip cabinet is arranged.

(7)

The acoustic reproduction device according to any one of (1) to (6), in which the housing includes a light transmitting member.

(8)

The acoustic reproduction device according to (7), in which a light emitter is provided near the one end inside the housing.

(9)

The acoustic reproduction device according to any one of (1) to (8), including a signal processing unit including a delay unit that delays an audio signal supplied to the first acoustic reproduction unit among same audio signals reproduced by the first acoustic reproduction unit and the second acoustic reproduction unit.

(10)

The acoustic reproduction device according to (9), in which the signal processing unit includes a phase correction unit that corrects a phase of an audio signal supplied to the first acoustic reproduction unit.

(11)

The acoustic reproduction device according to any one of (1) to (10), in which the speaker unit includes:

a diaphragm;

a magnetic circuit including a magnetic gap;

a bobbin attached to a voil coil attachment unit provided on the diaphragm; and a coil wound around the bobbin.

(12)

The acoustic reproduction device according to any one of (1) to (11), in which the vibration exciter includes a plurality of vibrating elements.

REFERENCE SIGNS LIST

5 Speaker device
10 First acoustic reproduction unit
11 Housing
20 Second acoustic reproduction unit
21 Cabinet
21A Main cabinet
21B Tip cabinet
25A, 25B, 25C Hole
111 Vibration exciter
112A, 112B, 112C Vibrating element
201 Diffuser
203 Speaker unit
207 Passive radiator
217A, 217B, 217C Opening
231 Metal plate

The invention claimed is:

1. An acoustic reproduction device, comprising:
a first acoustic reproduction unit; and
a second acoustic reproduction unit, wherein
the first acoustic reproduction unit includes:
a housing having a cylindrical shape; and
a vibration exciter configured to vibrate an end surface of one end of the housing,
the first acoustic reproduction unit is configured to output a first sound based on the vibration of the vibration exciter,
the second acoustic reproduction unit includes:
a speaker unit configured to output a second sound toward the first acoustic reproduction unit;
a diffuser configured to:
change a radiation direction of the second sound; and
control, based on the change in the radiation direction of the second sound, the radiation direction of the second sound to be substantially same as a radiation direction of the first sound; and
a cabinet that includes:
a tip cabinet that includes the vibration exciter and the one end of the housing; and
a main cabinet continuous with the tip cabinet,
the main cabinet is below the tip cabinet,
the main cabinet includes the diffuser and the speaker unit, and
the housing, the speaker unit, and the diffuser are substantially coaxial with a determined axis.

2. The acoustic reproduction device according to claim 1, wherein
the diffuser includes a first plurality of openings, and
the main cabinet includes a second plurality of openings in communication with the first plurality of openings.

3. The acoustic reproduction device according to claim 1, wherein
the main cabinet further includes:
a placement surface; and
a passive radiator substantially coaxial with the determined axis,
the passive radiator is configured to vibrate, and
the vibration generated by the passive radiator propagates to the placement surface of the main cabinet.

4. The acoustic reproduction device according to claim 3, wherein
the main cabinet further includes a metal plate in a vicinity of the placement surface inside the main cabinet, and
the passive radiator is connected to the metal plate.

5. The acoustic reproduction device according to claim 1, wherein the radiation direction of the second sound faces one of:
a side of the acoustic reproduction device opposite to a side of the tip cabinet, or
the side of the tip cabinet.

6. The acoustic reproduction device according to claim 1, wherein the housing includes a light transmitting member.

7. The acoustic reproduction device according to claim 6, further comprising a light emitter in a vicinity of the one end inside the housing.

8. The acoustic reproduction device according to claim 1, further comprising a signal processing unit that includes a delay unit, wherein
the first acoustic reproduction unit is further configured to:
receive a first audio signal; and
reproduce the received audio signal,
the second acoustic reproduction unit is further configured to:
receive a second audio signal; and
reproduce the received second audio signal, and
the delay unit is configured to delay the first audio signal received by the first acoustic reproduction unit.

9. The acoustic reproduction device according to claim 8, wherein
the signal processing unit further includes a phase correction unit,
the phase correction unit is configured to correct a phase of the audio signal received by the first acoustic reproduction unit.

10. The acoustic reproduction device according to claim 1, wherein the speaker unit includes:
a diaphragm that includes a voice coil attachment unit;
a magnetic circuit that includes a magnetic gap;
a bobbin attached to the voice coil attachment unit on the diaphragm; and
a coil wound around the bobbin.

11. The acoustic reproduction device according to claim 1, wherein the vibration exciter includes a plurality of vibrating elements.

* * * * *